US005186104A

United States Patent [19]

Lane

[11] Patent Number: 5,186,104

[45] Date of Patent: Feb. 16, 1993

[54] AUTOMATIC ENDORSER

[75] Inventor: Donald Lane, Trevose, Pa.

[73] Assignee: Brandt, Inc., Bensalem, Pa.

[21] Appl. No.: 720,194

[22] Filed: Jun. 24, 1991

[51] Int. Cl.[5] ..... B41F 5/00

[52] U.S. Cl. ..... 101/216; 101/91

[58] Field of Search ..... 101/91, 92, 216, 219

[56] References Cited

U.S. PATENT DOCUMENTS 4,434,715 3/1984 McHenry ..... 101/76

4,848,265 7/1989 Komari ..... 101/76

*Primary Examiner*—Clifford D. Crowder

*Assistant Examiner*—Ren Yan

*Attorney, Agent, or Firm*—Shenier & O'Connor

[57] ABSTRACT

An automatic endorser adapted selectively to apply an endorsement at different locations along the back of a check moving along a path extending between the endorser unit and the platen in a direction generally transverse to the check length. A select lever is adapted to be moved laterally of the check path to move the endorser to a position corresponding to a selected endorsement location. Visible means is provided for locking the select lever and endorser unit in position.

24 Claims, 7 Drawing Sheets

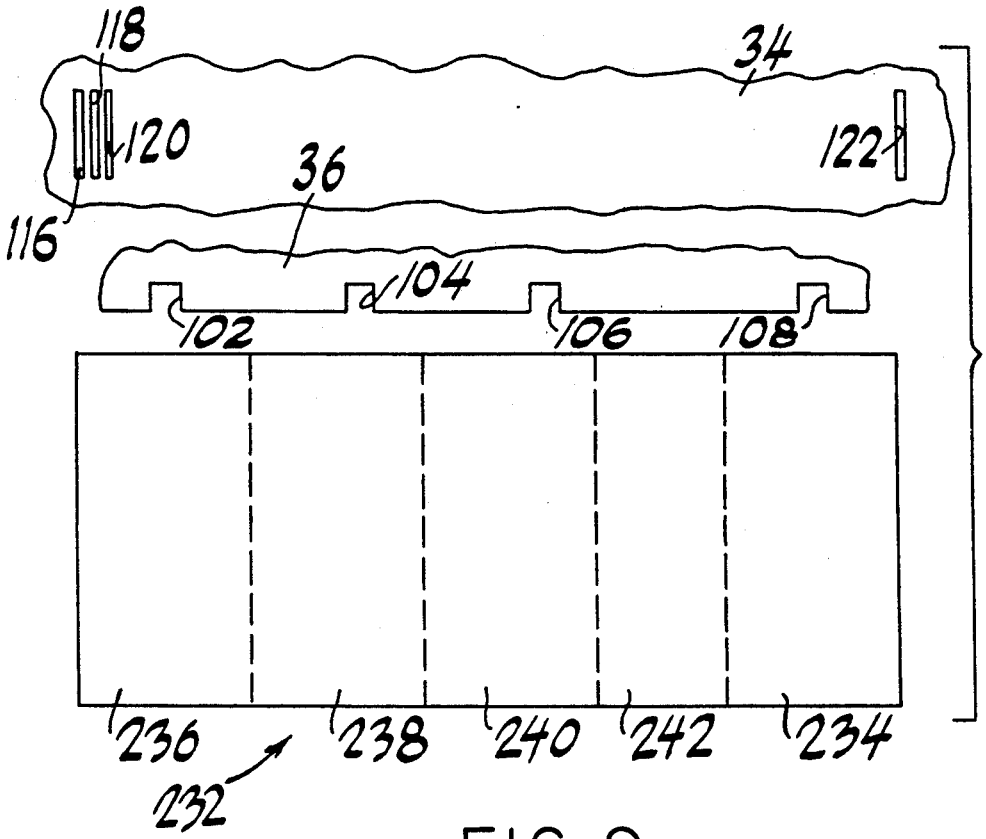
FIG. 9
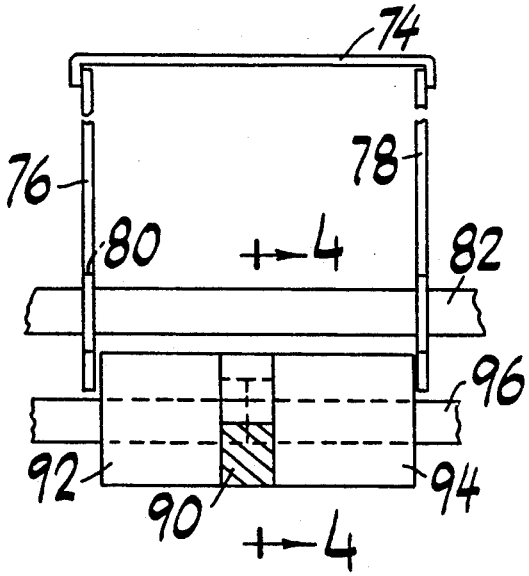
FIG. 3
FIG. 4
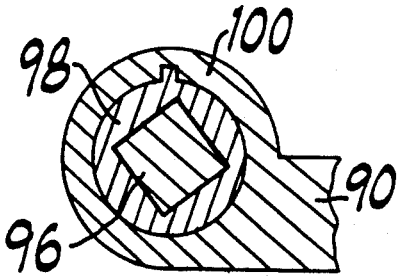

AUTOMATIC ENDORSER

FIELD OF THE INVENTION

The invention is in the field of automatic endorsers and relates to an improved automatic endorser which is more versatile than are endorsers of the prior art.

BACKGROUND OF THE INVENTION

There are known in the prior art automatic endorsers which operate at a high rate of speed to print an endorsement on negotiable instruments such as checks. These devices not only apply the endorsement to the checks but also count the number of documents which pass through the device. They are provided with a means for moving an endorser module between operative and inoperative positions so that the device can be used as a combination counter and endorser or merely as a counter. Devices of this type in the prior art are constructed and arranged to apply the endorsement to the back of the instrument at one fixed location along the length thereof.

Recently, in order to expedite the handling of checks, the federal authorities have promulgated regulations which define the locations of various endorsements on the back of a check. These regulations specify that the payee endorsement be applied to the check within a predetermined space from one end of the check. The spaces in which the endorsements of other financial institutions are to appear are defined with reference to the other end of the check. A variable size space between the (#2) depository area and the (#1) payee area accounts for checks of different size.

While automatic endorsers of the type described hereinabove operate satisfactorily in applying the endorsement to one particular fixed location on the back of a check, this location cannot readily be changed. Thus, endorsers of the prior art are not sufficiently flexible to accommodate the newly promulgated regulation.

SUMMARY OF THE INVENTION

One object of my invention is to provide an improved automatic endorser which is more versatile than are endorsers of the prior art.

Another object of my invention is to provide an improved automatic endorser which readily accommodates recently promulgated regulations.

A further object of my invention is to provide an automatic endorser in which the position at which the endorsement is placed on the check may be changed in a rapid and expeditious manner.

Still another object of my invention is to provide an automatic endorser which can handle checks of mixed sizes in a single run.

Yet another object of my invention is to provide an improved automatic endorser in which the endorsement drum is resiliently loaded down onto the platen roll as the endorser unit is brought into its operative position.

Yet another object of my invention is to provide an improved automatic endorser which permits the position of the endorsement to be varied while at the same time reducing the likelihood of paper jams.

Other and further objects will appear from the following description.

BRIEF DESCRIPTION OF THE DRAWINGS

FIG. 3 is a fragmentary elevation of my improved automatic endorser with a part shown in section and with other parts removed.

FIG. 4 is a sectional view along the line 4—4 of FIG. 3 drawn on an enlarged scale.

FIG. 9 is a partially schematic view illustrating the operation of my improved automatic endorser.

DESCRIPTION OF THE PREFERRED EMBODIMENT

Figure 1:
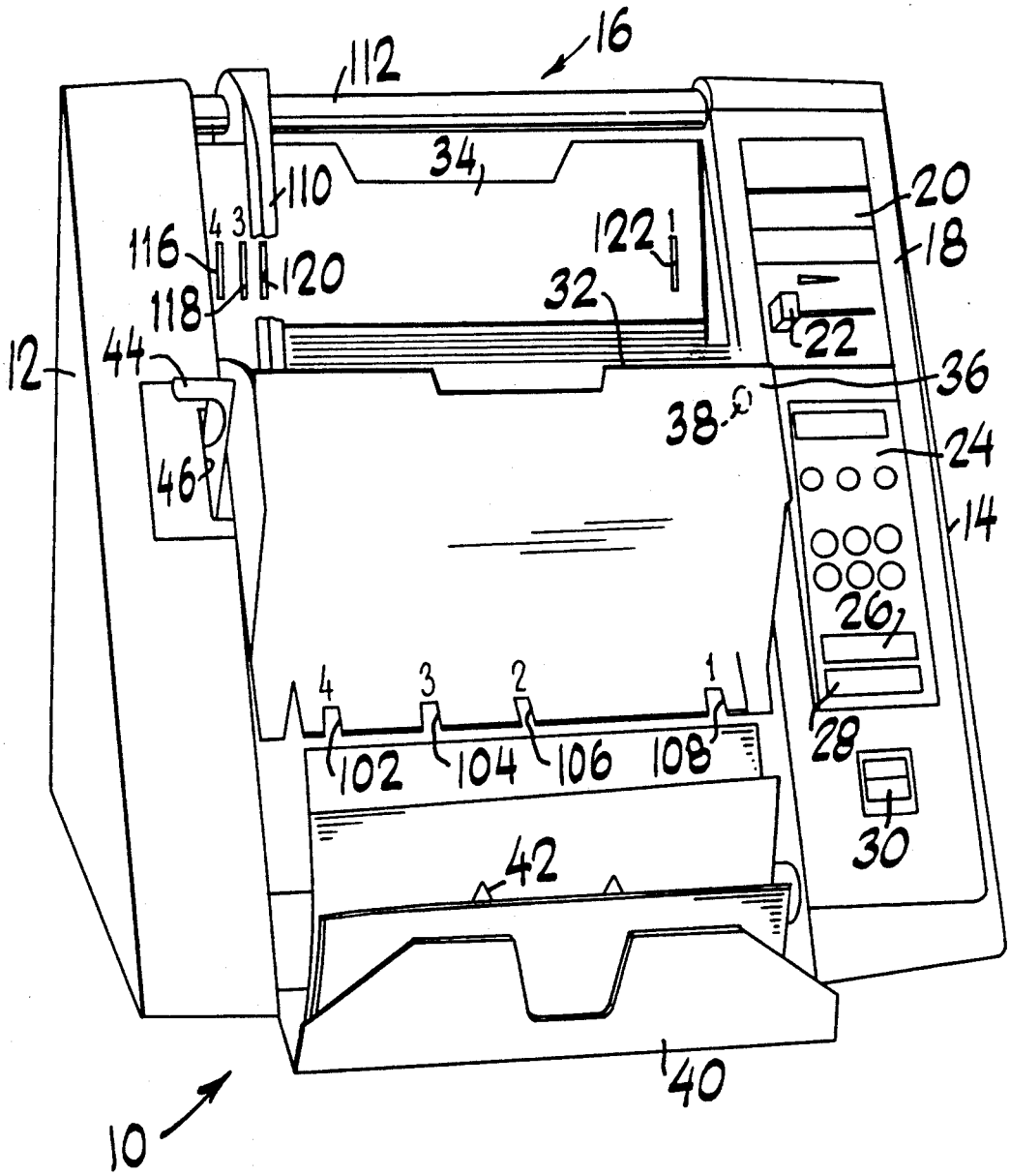
FIG. 1 is a perspective view of my improved automatic endorser.

Referring now to FIG. 1 of the drawings, my improved automatic endorser indicated generally by the reference character 10 includes a left-hand housing 12 and a right-hand housing 14 separated by a center section indicated generally by the reference character 16. The right-hand housing 14 carries a panel 18 provided with a window 20 through which information such as a count may be displayed.

A dark/light control 22 permits the intensity of the doubles detection to be varied.

A keyboard 24 on the panel 18 carries a start actuator 26 and a stop actuator 28.

An On/Off button 30 can be actuated to turn the power on and off.

The central section 16 of my improved endorser includes an in feed tray 32 on which checks to be endorsed are placed so as to rest against a back plate 34. A cover 36 is pivotable around pivots 38 between a position at which it overlies the endorser inkroll mechanism and a position at which this mechanism is exposed. A delivery tray 40 is adapted to receive checks which have been endorsed from a stacker 42 of a suitable type known in the art.

An endorser activating arm or handle 44 extends downwardly through a slot 46 in the left-hand housing 12.

Figure 2:
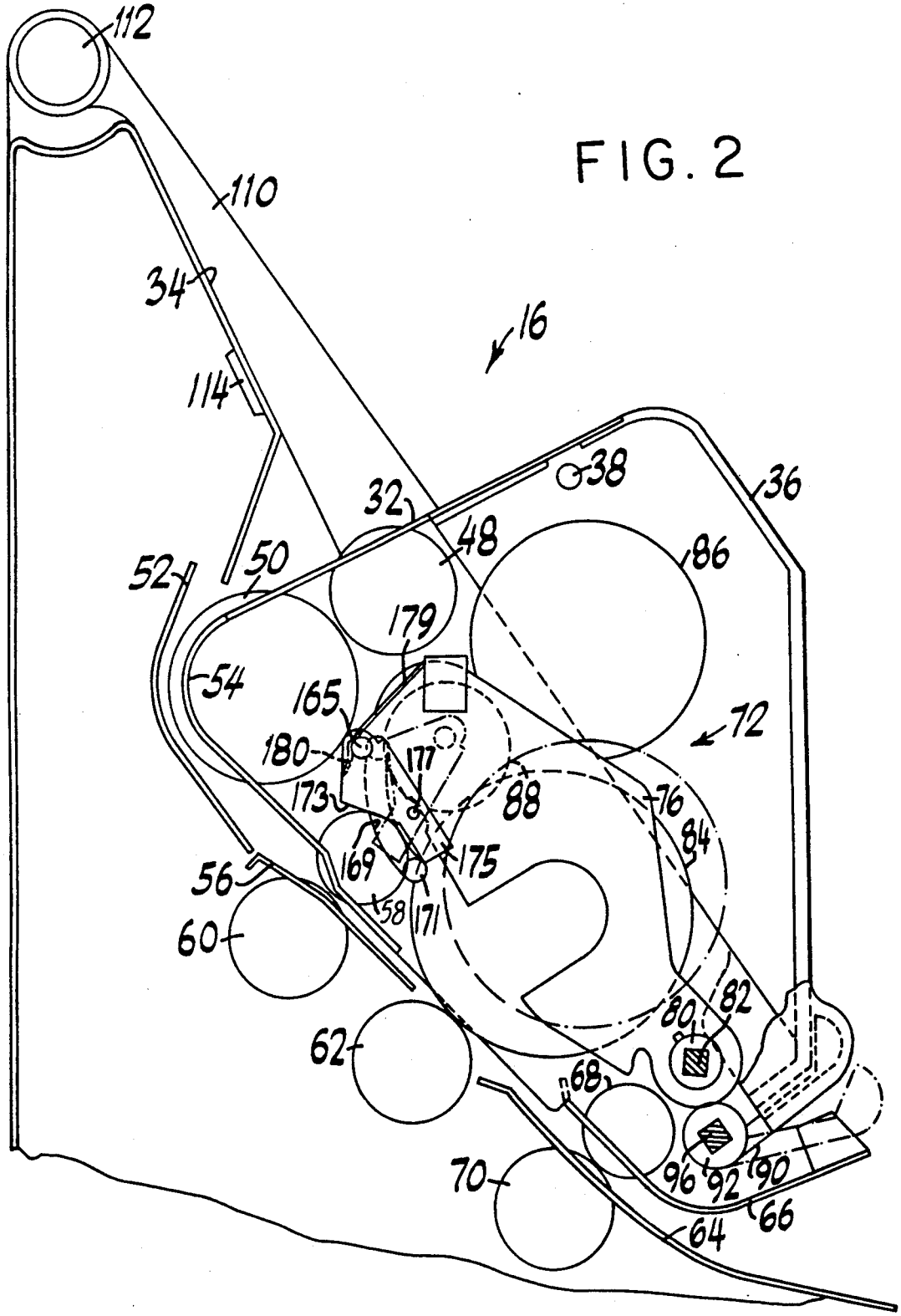
FIG. 2 is a sectional view of my improved automatic endorser showing the paper feed path.

Referring now to FIGS. 2 to 4, the paper handling mechanism of my improved endorser includes a picker roll 48 adapted to be driven to feed checks one at a time from the bottom of a stack on tray 32 to a feed roller 50 which advances the checks along a path formed by an upper outer guide 52 and an upper inner guide 54 to an auxiliary guide 56 which directs the checks to the nips between first pairs of accelerating rolls 58 and 60

From the accelerating rolls 58 and 60 checks are advanced over the platen roll 62 to the space between a lower outer guide 64 and a lower inner guide 66 whereat they are subjected to the action of second pairs of accelerating rolls 68 and 70. The sheets are then advanced by the stacker 42 to the delivery tray 40.

The endorser unit indicated generally by the reference character 72 includes a inverted U-frame 74 having legs 76 and 78 carrying bushings 80 by means of which the unit 72 is supported on a shaft 82 of non-circular, such as square cross-sectional shape, for rotation therewith and for sliding movement therealong.

In a manner known to the art, the frame 74 supports the endorser wheel 84, an inking roll 86 and an ink transfer roll 88.

My improved endorser includes an endorser unit position selecting lever 90 having a hub 100 which is keyed to reduced diameter parts 98 of a pair of bushings 92 and 94 carried by a second shaft 96 of non-circular or square cross-sectional shape.

Referring to FIGS. 1 to 4, the lever 90 has four respective endorser unit locking positions at which the lever is disposed in respective notches 102, 104, 106 and 108 in the lower edge of the cover 36. When the lever 90 is not in one of its locking positions as indicated by the dot-dash line in FIG. 2, it can be moved laterally back and forth along the shaft 96. When this is done the frame 74 and the endorser unit 72 carried thereby will move with the lever owing to the engagement of the edges of the bushings 92 and 94 with the lower ends of the legs 76 and 78.

My improved endorser includes a document spacer arm 110 swingably carried by a combined carry handle and shaft 112 at the top of the machine. The spacer arm 110 has a tang 114 adapted selectively to engage in one of a plurality of slots 116, 118, 120 and 122 formed in the back plate 34. As will be explained more fully hereinbelow, slots 116, 118, 120 and 122 correspond to the respective notches 102, 104, 106 and 108. Further, as will be explained hereinbelow, in operation of the device the ends of a stack of checks to be endorsed bear against the arm 110.

Figure 5:
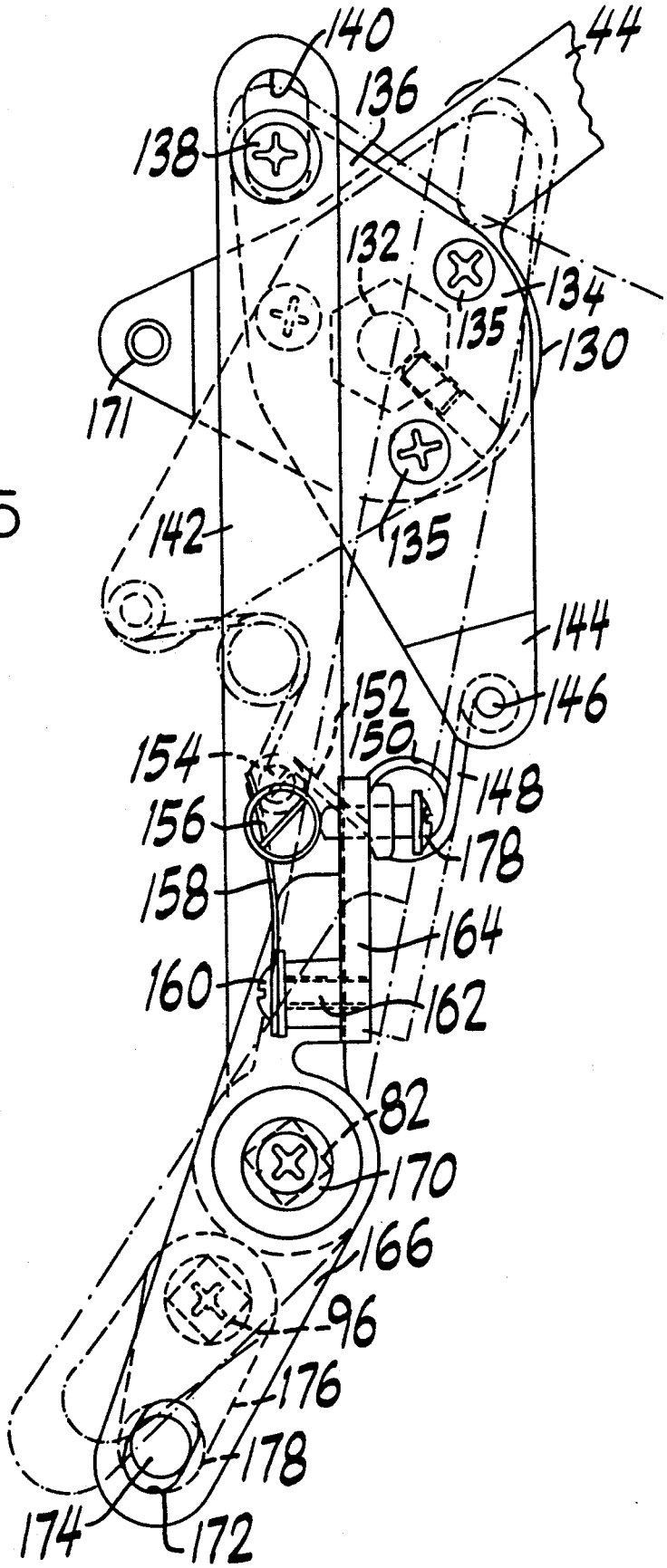
FIG. 5 is a side elevation of the endorser activating mechanism of my improved automatic endorser.
Figure 6:
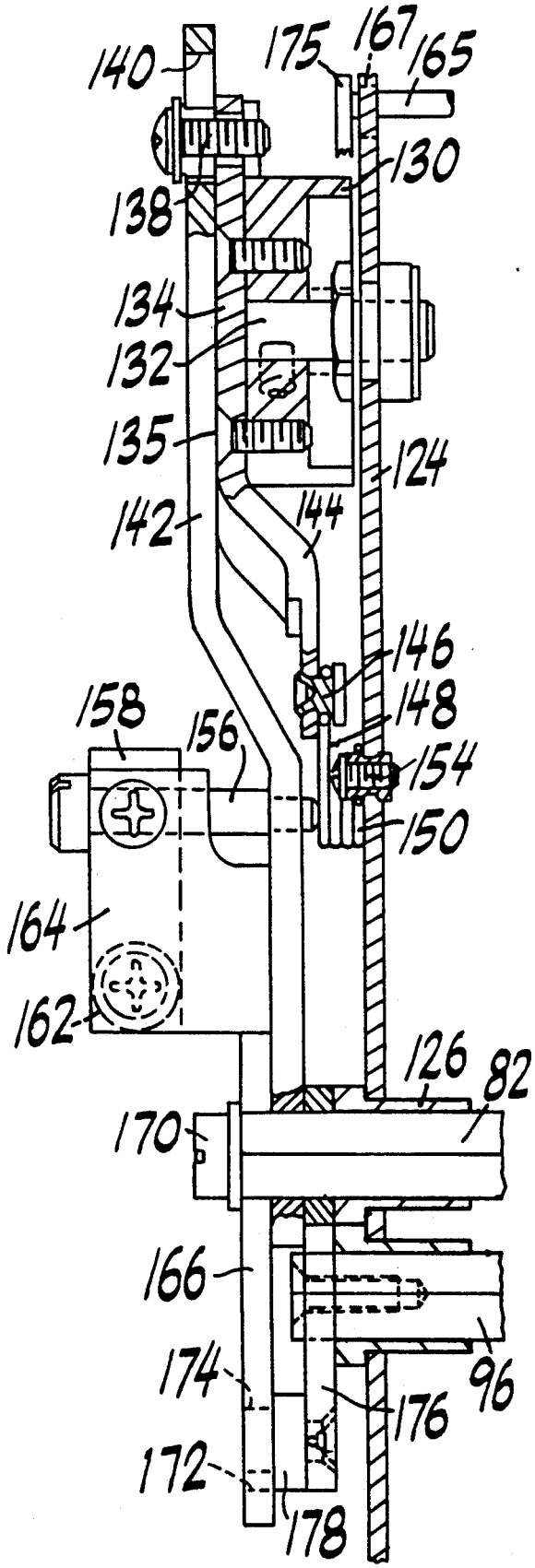
FIG. 6 is a front elevation of the mechanism illustrated in FIG. 5 with parts shown in section.

Referring now to FIGS. 5 and 6, a support wall 124 of my machine carries respective bushings 126 and 128 which support the shafts 82 and 96 for rotary movement on the wall 124.

Handle 44 has a hub 130 rotatably carried on a shaft 132 supported in the wall 124. Any suitable means, such for example as screws 135, secure a bell crank 134 to the hub 130 for movement therewith. One arm 136 of the bell crank 134 carries a pin 138 which rides in a slot 140 of an endorser shaft drive arm 142 carried by the shaft 82 for rotation therewith. The other arm 144 of the bell crank 134 supports a pin 146 which receives one end 148 of a torsion spring 150. The other end 152 of torsion spring 150 is secured to a pin 154 on the wall 124.

In the position of the parts illustrated in FIGS. 5 and 6, the endorser unit 72 is in its operative position at which the endorser wheel 84 is loaded against the platen roll 62. To move the endorser unit 72 to its inoperative position, handle 44 is moved in a clockwise direction as viewed in FIG. 5. When this occurs, pin 138 moves arm 142 in a clockwise direction to rotate the shaft 82 through an angle sufficient to move the endorser unit 72 to such a position that the wheel 84 occupies the dot-dash position shown in FIG. 2.

As the handle 44 is operated in the manner just described, the torsion spring 150 is displaced from the full line position shown in FIG. 5 to the dot-dash line position shown therein. When the operation of the parts is reversed to move the endorser unit 72 into its operative position, spring 150 moves from the dot-dash line position to the full line position of FIG. 5 to load the wheel 84 against the platen roll 62.

At a point intermediate its ends, the arm 142 carries a driving post or stud 156 which extends outwardly from the arm 142 and into cooperative relationship with a leaf spring 158 secured by a screw 160 carrying a spacer 162 to a lateral flange 164 on the upper end of a lever 166 supported for pivotal movement around the axis of the shaft 82 by means of a screw 170 on the end of the shaft. A slot 172 in the lower end of lever 166 receives the reduced diameter end 174 of a driving post and spacer 178 secured to an arm 176 carried by shaft 96 for rotation therewith.

Referring to FIGS. 2, 5 and 6, my machine includes a lifter bar 165 which extends across the machine behind endorser unit 72 between support wall 124 and another support wall (not shown) at the other side of the machine. Slots 167 in these walls support the bar 165 for arcuate movement. A roll pin 171 on an extension of hub 130 rides in a slot 169 in wall 124. Pin 171 is adapted to engage a cam surface 173 on the underside of a lifter bar operating lever 175 on one end of bar 165 to pivot the lever 175 around a pivot pin 177 on wall 124 in a clockwise direction as viewed in FIG. 2 from the full line position to the dot-dash line position. This corresponds to movement of the endorser unit for operative to inoperative position. The resultant movement of lifter bar 165 tends to move the endorser unit 72 in a clockwise direction as viewed in FIG. 2 to unload shaft 82 to facilitate movement of the unit 72 along the shaft.

A pulldown plate 179 secured to the upper end of the endorser unit 72 is adapted to ride over the lifter bar 165. In the course of movement of the parts from the inactive position of the endorser unit to the active position thereof, a hook 180 on plate 179 is engaged by bar 165. During the last part of the movement of roll pin 171 it acts on surface 173 to cause bar 165 to pull the upper end of the endorser unit against the platen roll 62. By thus clamping the endorser module in position, I have eliminated problems which otherwise might arise owing to eccentricity in either the drum or the platen roll which would produce bounce of the drum 84 on the platen 62 at relatively high speeds.

It will be noted that the slot 169 which receives the roll pin 171 serves to limit the movement of handle 44 between the position at which the endorser unit 72 is inactive and the position at which the unit is active.

Figure 7:
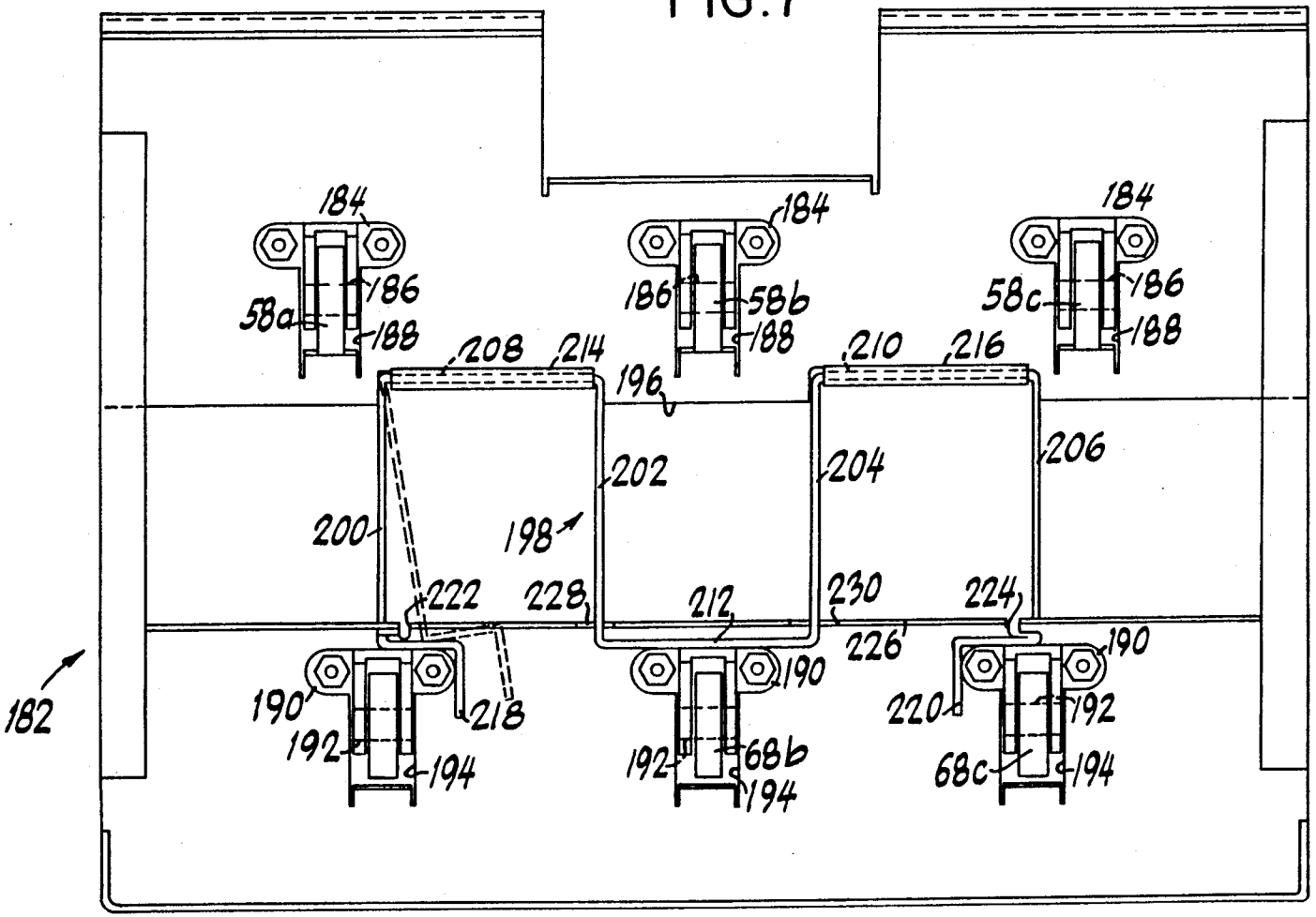
FIG. 7 is an elevation of a portion of the document guide and transfer mechanism of my improved automatic endorser.
Figure 8:
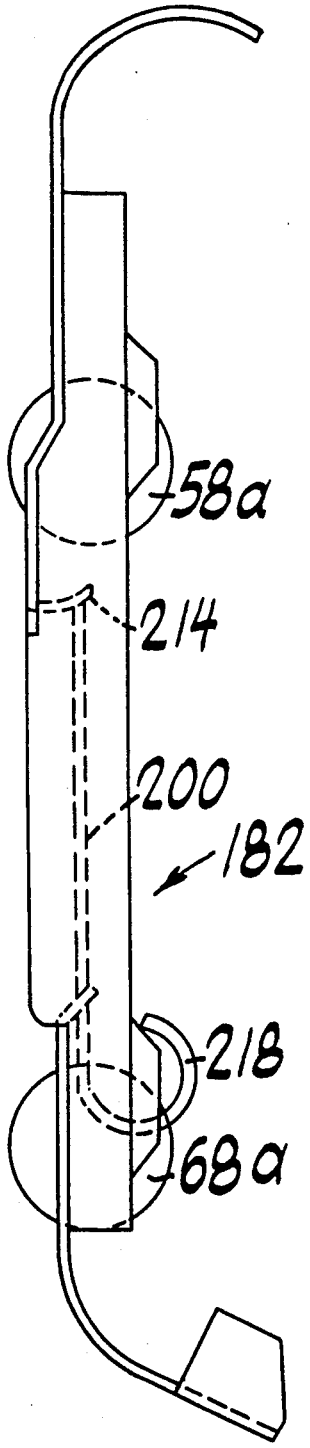
FIG. 8 is a side elevation of the mechanism illustrated in FIG. 7.

Referring now to FIGS. 7 and 8, I have shown the guide and transfer member indicated generally by the reference character 182 of my improved endorser. This member carries a plurality of brackets 184 which support shafts 186 carrying respective accelerator idler rolls **58*a*, 58*b* and 58*c* over openings 188** in the plate.

Brackets 190 carry shafts 192 for supporting the secondary acceleration rollers **68*a*, 68*b* and 68*c* at openings 194**.

Owing to the fact that endorsements are to be applied to the check over substantially the entire length thereof, member 182 is formed with a relatively large platen roll opening 196. At the high speeds at which my device is to operate, such a large opening might give rise to possible paper jams. In order to obviate such problems, I provide my machine with a retainer wire form indicated generally by the reference character 198 having spaced vertical legs 200, 202, 204 and 206. Respective upper horizontal extents 208 and 210 connect the upper ends of legs 200 and 202 and of legs 204 and 206. A lower extent 212 connects the lower ends of legs 202 and 204.

I dispose horizontal extents 208 and 210 in retainer flanges 214 and 216 formed in the member 182 along the upper edge of opening 196.

I form the lower ends of legs 200 and 206 with respective loops 218 and 220 which can be actuated to move the legs 200 and 206 into and out of retainer notches 222 and 224 in a flange 226 extending along the lower edge of the opening 196. By way of example I have illustrated a broken line position of leg 200 and its associated loop 218 at which the leg is out of the retainer notch 222. In the operative position of the form 198, the lower ends of legs 202 and 204 are disposed in notches 228 and 230 in the flange 226.

Referring now to FIG. 9, I have illustrated a check indicated generally by the reference character 232 back side up and up side down. Under the current Federal regulations, the payee endorsement is to be located within an area 234 measured from the right as viewed in FIG. 9. Other endorsements are to be made in areas 236, 238 and 240 measured from the left edge of the check 232, as viewed in FIG. 9. A variable space 242 accounts for difference in sizes of checks as between personal checks and business checks.

Where payee endorsements are to be made in space 234, the select lever 90 together with the endorser module 92 is moved in a manner to described to a position at which lever 90 is within the slot 108. The document spacer is moved to a position at which its tang 114 is in slot 122. Next, the bottom and left-hand edges of the checks to be endorsed are aligned. The resultant stack is placed upside down as viewed from the front of the machine with the aligned shorter edges in engagement with spacer 110 and the aligned bottom edges facing the slot formed between the lower edge of back wall 34 and the input tray 32. With power on and with start button 26 pressed, the checks will be moved one by one in a manner known to the art through the feed path past the endorser unit 72 which prints the endorsement in the space 234 and then into the output tray 40 by means of a stacker 42.

When endorsements are to be made in any of the areas 236, 238 and 240, the lever 90 and the endorser unit 72 are moved to respective positions at which lever 90 is in notch 102, 104 or 106 and at which the document spacer 110 is so positioned that its tang 114 is in one of the slots 116, 118 or 120.

In operation of the mechanism for moving the endorser unit 72 and the select lever 90 between active and inactive positions with the parts in the inactive position at which the print wheel 84 is away from the platen at roll 62 and the select lever 90 is not in engagement with any of the slots, 102, 104, 106 or 108 as indicated by the dot-dash lines in FIG. 2 and with the operating elements in the dot-dash line positions shown in FIG. 5, the lifter bar 180 is in a position at which it engages the unit 72 to unload shaft 82. Now the lever 90 may be grasped and moved laterally of the unit until it is aligned with the desired slot 102, 104, 106 or 108. Next, handle 44 is moved in a counterclockwise direction as viewed in FIG. 5. When this occurs, arm 142 is driven in a counterclockwise direction to rotate shaft 82 to bring print wheel 8 into engagement with the platen roll 62 at a location corresponding generally to the areas in which the endorsement is to be printed.

Further in response to the movement of arm 44 from the dot-dash line position of FIG. 5 to the full line position, spring 150 is wound up to load the print wheel 84 against platen wheel 62. In the course of this movement the pulldown plate 180 causes the upper end of the unit 72 to be pulled downwardly.

When arm 142 moves from its dot-dash line position to its full line position, stud 156 engages leaf spring 158 to drive lever 166 in a counterclockwise direction as viewed in FIG. 5. Owing to the coupling provided by pin 174 and slot 172, lever 166 drives arm 176 to move lever 90 into the slot 102, 104, 106 or 108 with which it is aligned. If for any reason the lever 90 is not aligned with one of the slots, the leaf spring 158 permits relative motion between arm 142 and lever 166 to prevent damage to the parts. Unit 72 and the lever 90 may be moved from their operative to their inoperative positions by moving arm 144 from the full line position shown in FIG. 5 to the dot-dash line position.

It is to be remembered that after the endorser unit 72 has been properly positioned in the manner just described, the document spacer must be so positioned that its tang 114 is in the slot 116, 118, 120 or 122 corresponding to the notch 102, 104, 106 or 108 occupied by the lever 90. It is to be emphasized that the lever 90 not only functions as a means by which the operator can move the endorser unit laterally of the machine, but also it acts as a detent member to lock the endorser unit in position. In addition, it provides a ready indication to the operator of the position occupied by the endorser unit.

I have provided an arrangement in which the endorser lever 90 is moved independently of the document spacer 110. It will readily be appreciated that these elements could be so arranged as to move in synchronism, one in response to the other. This might be accomplished through a coupling between the two or by automatic means in which a button or the like is pressed to cause the parts properly to occupy the positions corresponding to one of the areas to be endorsed.

It will also be appreciated that the wire form 198 provides excellent control over documents as they move past the opening 196 in the member 182. At the same time the wire form 198 affords access to those areas of the platen corresponding to areas to be endorsed. The wire form 198 may readily be removed in the event that a jam does occur.

It will be seen that I have accomplished the objects of my invention. I have provided an improved automatic endorser which is more versatile than are endorsers of the prior art. My improved endorser permits the location of the endorsement to be changed in a rapid and expeditious manner. It handles checks of mixed sizes in a single run. It obviates problems which otherwise might arise owing to eccentricity in the parts. It minimizes jams.

It will be understood that certain features and subcombinations are of utility and may be employed without reference to other features and subcombinations. This is contemplated by and is within the scope of my claims. It is further obvious that various changes may be made in details within the scope of my claims without departing from the spirit of my invention. It is, therefore, to be understood that my invention is not to be limited to the specific details shown and described.

Having thus described my invention, what I claim is:

1. Apparatus for selectively applying an endorsement to checks at different locations along the back of a check including in combination, a platen, an endorser unit, means mounting said endorser unit for movement relative to said platen between an inactive position and an active position at which it applies an endorsement to a check moving between said unit and said platen, means for moving checks along a path past said endorser unit and said platen, said path being generally perpendicular to the length of a check, means mounting said endorser unit for movement laterally of said path to positions corresponding to said locations, means operable in the inactive position of said endorser unit for moving said unit to one of said positions, means for locking said unit in the position to which it has been moved, a guide extending along said platen in relatively closely spaced relationship thereto for guiding checks past said platen and a cover member having a plurality of notch means spaced laterally therein, wherein said means for moving said unit laterally moves said unit and said means for locking said unit includes a select lever engagable with one of said plurality of notch means.

2. Apparatus as in claim 1 in which said means mounting said endorser for movement relative to said platen comprises means for loading said unit against said platen in the active position of the unit.

3. Apparatus as in claim 1 including means for concomitantly moving said endorser unit to its active position and activating said locking means.

4. Apparatus as in claim 3 in which said means for activating said locking means comprises a resilient connection permitting lost motion in the event that said locking means is inoperative.

5. Apparatus as in claim 1 in which said guide is a wire form providing access to said platen at locations corresponding to said endorsement locations.

6. Apparatus as in claim 5 including means for manually releasably retaining said wire form in position.

7. Apparatus as in claim 6 in which said wire form retaining means comprises a hinge supporting said form for movement between a closed position adjacent said platen and an open position clear of said platen for access to any jammed check and a manually releasable catch for holding the wire form in its closed position.

8. Apparatus for selectively applying an endorsement to checks at one of a number of different locations along the back of a check including in combination, a frame, a platen on said frame, an endorser unit, means including a first shaft mounting said endorser unit on said frame for swinging movement toward and away from said platen between an active position and an inactive position and for sliding movement therealong to set positions corresponding to said endorsement locations, an input tray for receiving a stack of checks to be endorsed, means moving checks from said stack along a path extending between said platen and said endorser unit along a line generally perpendicular to the length of said checks, a select lever, means including a second shaft mounting said select lever for rotary movement therewith and for axial movement therealong, means responsive to movement of said select lever along said second shaft for moving said endorser unit along said first shaft, means on said frame for engagement by said select lever in one rotary position thereof for locking said select lever against movement along the second shaft and means for concomitantly moving said endorser unit to its active position and said select lever to said one rotary position.

9. Apparatus as in claim 8 in which said means for moving said endorser unit comprises interengageable means on said select lever and on said endorser unit whereby said select lever locking means locks said endorser unit against movement along said first shaft.

10. Apparatus as in claim 9 in which said select lever locking means comprises a member on said frame formed with a notch at a location which is visible to the machine operator, said notch receiving said lever in said one rotary position thereof whereby said lever provides a visible indication of the location of said endorser unit.

11. Apparatus as in claim 10 in which said member is formed with a number of notches at positions corresponding to said endorsement locations.

12. Apparatus as in claim 11 including a check edge aligning element and means mounting said element on said frame for movement to positions corresponding to said endorsement locations.

13. Apparatus as in claim 12 including interengageable means on said frame and on said element for releasably holding said element in position.

14. Apparatus as in claim 8 including a check edge aligning element and means mounting said element on said frame for movement to positions corresponding to said endorsement locations.

15. Apparatus as in claim 14 including interengageable means on said frame and on said element for releasably holding said element in position.

16. Apparatus as in claim 8 in which said first shaft receives the lower end of said endorser unit whereby said unit imposes a load on said first shaft in the inactive position of the unit, said means for concomitantly moving said endorser unit and said select lever comprising a handle mounted on said frame for movement between first and second positions corresponding respectively to the active and inactive positions of said endorser unit and means responsive to movement of said handle to said first position for relieving said load on said first shaft.

17. Apparatus as in claim 17 in which said load relieving means comprises a lifter bar, means mounting said lifter bar on said frame for movement between a first position out of engagement with said endorser unit and a second position at which it engages the upper end of said endorser unit to relieve said load, and means responsive to movement of said handle from its first position to its second position for moving said lifter bar from its first position to its second position.

18. Apparatus as in claim 17 including means on said endorser unit for engaging said bar in the second position of said handle for holding said endorser unit against said platen.

19. Apparatus as in claim 8 in which said means for concomitantly moving said endorser unit and said select lever comprises a handle mounted for limited movement on said frame between first and second positions corresponding respectively to the active and inactive positions of said endorser unit, a first drive member carried by said first shaft, a resilient toggle connection between said handle and said first drive member responsive to movement of said handle from said second position to said first position for holding said handle in said first position and resiliently biasing said endorser unit against said platen, a second drive member carried by said second shaft, and a resilient drive connection between said first and second drive members responsive to movement of said handle from said second position to said first position.

20. Apparatus for selectively applying an endorsement to checks at one of a number of different locations along the back of a check including in combination, a frame, a platen on said frame, an endorser unit, means including a first shaft mounting said endorser unit on said frame for swinging movement toward and away from said platen between an active position and an inactive position and for sliding movement therealong to set positions corresponding to said endorsement locations, an input tray for receiving a stack of checks to be endorsed, means moving checks from said stack along a path extending between said platen and said endorser unit along a line generally perpendicular to the lengths of said checks, a select lever, means including a second shaft mounting said select lever for rotary movement therewith and for axial movement therealong, interengageable means on said select lever and on said endorser unit to cause the endorser unit to move along said first shaft as said select lever moves along said second shaft, means on said frame formed with a plurality of spaced notches at locations corresponding to said endorsement locations, said notches adapted to receive said select lever in one rotary position thereof for locking said select lever and said endorser unit against movement along their respective shafts, a handle, means mounting said handle for limited movement on said frame between first and second positions corresponding to the active and inactive positions of said endorser unit, a first drive member carried by said first shaft, a resilient toggle connection between said handle and said first drive member responsive to movement of said handle from said second position to said first position for holding said handle in said first position and resiliently biasing said endorser unit against said platen, a second drive member carried by said second shaft, and a resilient drive connection between said first and second drive members responsive to movement of said handle from said second position to said first position.

21. Apparatus as in claim 20 including a check edge aligning element and means mounting said check edge aligning element on said frame for movement to positions corresponding to said endorsement locations.

22. Apparatus as in claim 20 in which said first shaft receives the lower end of said endorser unit whereby said unit imposes a load on said first shaft in the inactive position of the unit, said apparatus including means responsive to movement of said handle to said first position for relieving said load on said first shaft.

23. Apparatus as in claim 22 in which said load relieving means comprises a lifter bar, means mounting said lifter bar on said frame for movement between a first position out of engagement with said endorser unit and a second position at which it engages the upper end of said endorser unit to relieve said load, and means responsive to movement of said handle from its first position to its second position for moving said lifter bar from its first position to its second position.

24. Apparatus as in claim 23 including means on said endorser unit for engaging said bar in the second position of said handle for holding said endorser unit against said platen.

* * * * *

UNITED STATES PATENT AND TRADEMARK OFFICE

CERTIFICATE OF CORRECTION

PATENT NO. : 5,186,104

DATED : February 16, 1993

INVENTOR(S) : Donald Lane

It is certified that error appears in the above-identified patent and that said Letters Patent is hereby corrected as shown below:

Col. 8, line 29, Claim 17:

Change "17" (second occurrence) to --16--.

Signed and Sealed this

Second Day of November, 1993

*Attest:*

Bruce Lehman

BRUCE LEHMAN

*Attesting Officer*

*Commissioner of Patents and Trademarks*